United States Patent [19]

Brooks

[11] Patent Number: 4,649,972

[45] Date of Patent: Mar. 17, 1987

[54] FURNITURE ROUND TENON CRIMPER

[75] Inventor: Kenneth Brooks, Charlotte, N.C.

[73] Assignee: York Industries, Inc., Charlotte, N.C.

[21] Appl. No.: 796,059

[22] Filed: Nov. 7, 1985

[51] Int. Cl.[4] ..... B27M 1/02

[52] U.S. Cl. ..... 144/361; 144/2 R; 144/49

[58] Field of Search ..... 144/2 R, 12, 49, 361

[56] References Cited

U.S. PATENT DOCUMENTS 2,681,086 6/1954 Degen ..... 144/12

FOREIGN PATENT DOCUMENTS 558672 3/1957 Italy ..... 144/12

788574 2/1958 United Kingdom ..... 144/12

*Primary Examiner*—W. D. Bray

*Attorney, Agent, or Firm*—Ralph H. Dougherty

[57] ABSTRACT

Method and apparatus for crimping a round tenon for furniture manufacture, utilizing a crimping roll cluster consisting of a knurled drive roll and two idler compressing rolls. The apparatus includes means for feeding a wooden workpiece into and out of axial alignment with the crimping roll cluster; means for pressing the wooden workpiece into engagement with the knurled portion of the drive roll; means for rotating the workpiece from one to two revolutions, thus forming flutes into the tenon; and means for discharging the workpiece from the apparatus.

Also disclosed is a method and apparatus for fluting a workpiece having tenons on both ends.

35 Claims, 5 Drawing Figures

FURNITURE ROUND TENON CRIMPER

BACKGROUND OF THE INVENTION

This invention relates to round tenon joints in the furniture industry, particularly tenon joints for chair legs, spindles, and other wood parts wherein a round tenon is inserted into a mortise or blind hole and secured therein with glue.

Round tenon joints are traditional in the furniture industry and are the most common joints used in the manufacture of wooden chairs. Chair legs have a tenon on one end, while spindles and other wooden parts which form joints at both ends on assembly have tenons on each end.

Round tenon joints have a number of major disadvantages. First, the tolerance between the tenon and the hole into which it fits must be very closely controlled for a press fit. If the joint is too loose, it will come apart. If there is insufficient clearance between the dimensions of the mortise hole and the tenon, the parts will not fit together easily, and assembly will be difficult. Further, glue that is placed in the joint during assembly is mostly wiped to the bottom of the mortise hole, leaving little or no glue on the tenon to interface with the inner surface of the hole, which creates a very weak joint.

It is known from U.S. Pat. No. 2,702,926 that a compressed dowel pin having longitudinal grooves can be employed in a conventional mortise to effect even distribution of glue between the pin and the mortise and form a strong bond under substantial pressure. The present invention is a machine for forming such grooves onto a round, shouldered tenon, such as on the end of a chair leg. A grooving machine for accomplishing the same objective is shown in MacQueston Pat. No. 3,651,483, in which a workpiece having a tenon at one end or at each end is held in a stationary position, and a movable die, characterized as an annular compressor fluting die, moves onto the work piece, cutting flutes into the tenon. A different fluting tool is used for each diameter of tenon which is to be processed. Centering of the workpiece is also necessary to achieve a properly centered fluted tenon.

Rahaim, in U.S. Pat. No. 2,702,926, teaches that a dowel can be compressed by a series of opposed grooved rolls. He finds it important that the grooving and contracting of the dowel does not create such a violent compression as to crush the dowel fibers.

The present invention both grooves and compresses a round tenon for a mortise and tenon joint, particularly for the manufacture of furniture. The present invention has several distinct advantages over the teachings of the prior art, the principal advantages being:

(1) Grooving of the tenon allows glue to remain within the joint rather than being wiped to the bottom of the mortise hole upon assembly, and weakening the joint.

(2) Compressing of the tenon creates an expanding force within the joint at the time the compressed fibers react to the moisture of the glue.

(3) The invented apparatus has the ability to compress the tenon to a well controlled, accurate diameter.

(4) The invented apparatus is also adaptable to other manufacturing systems, for example, it can stand alone as a single end crimping machine, or it can be readily modified to a double end crimping machine. None of the other systems taught in the art can do this.

Currently-used machines employ a hand-feeding method wherein an operator must place the tenon in the operative position in the crimping mechanism. The present invention is a totally automatic mechanism in which one workpiece, or a series of wooden workpieces, each having a tenon end or ends, are fed into position for crimping, crimping of the tenon, or tenons, is accomplished, and the workpiece is ejected.

OBJECTS OF THE INVENTION

It is a principal object of the present invention to provide apparatus for automatically compressing one or both ends of tenoned components, such as chair legs, spindles, stretchers, or posts.

It is also an object of the present invention to provide a strong mortise and tenon joint through automated means whereby such means is a freestanding machine.

It is another object of this invention to provide a tenon crimping apparatus, which can be fed from a hopper.

It is also an object of this apparatus to provide a tenon crimping machine which can be operated at rates up to 1000 workpieces per hour and incorporated into automatic multipleoperation manufacturing systems.

It is another object of this invention to provide a crimping machine which can be easily adapted from one length or diameter of workpiece to another.

It is also an object of this invention to provide a tenon crimping machine which is easily maintained.

SUMMARY OF THE INVENTION

In the present invention, a three-roll crimping mechanism is used. One roll is driven and two are idlers (undriven). The drive roll contains straight knurling (grooves) on its periphery, parallel with its axis, and the two idler compression rolls are smooth.

The tenon can be fed into position for crimping in several ways. The crimping rolls can be moved a sufficient distance apart that the tenon can be fed into crimping position through the gap between the rolls. In a second, and more preferable, way, the workpiece is moved into axial alignment with the crimping roll cluster, the rolls are opened, and the tenon is then moved axially into the crimping position. The third way for positioning the tenon is for the workpiece to be positioned axially with the rolls in the open position, then the crimping head to be moved in relation to the workpiece, the workpiece remaining stationary, so that the tenon is in position for crimping.

In operation, it has been found that the optimum rotation of the tenon is one and one-quarter ($1\frac{1}{4}$) rotations, but the invention is operable over a limit of from one rotation to two rotations of the tenon.

The workpiece with the tenon end is fed into axial alignment with the crimping apparatus, then moved into crimping position. The idler rolls, which are positioned on a lever arm, push the tenon into engagement with the knurled portion of the crimping roll.

The apparatus operates on a series of timed delays, as follows:

the crimping roll rotates at all times:

the tenon is fed into axial alignment, generally with the center of the three-roll cluster, the idler roll lever arm is actuated, lifting the workpiece tenon into engagement with the crimping roll;

the idler roll lever arm is released; and the workpiece is discharged from the crimp feeding position. In the event that the rolls in the three-roll cluster do not open sufficiently to admit the tenon and/or align the tenon correctly for crimping, either the crimping head or the tenon is moved laterally into crimping position. When the crimping machine is utilized to crimp both ends of a workpiece, a crimping head is provided at each end of the machine, and both ends are crimped or fluted simultaneously. One of the crimping heads is laterally movable to accomodate various lengths of workpiece.

BRIEF DESCRIPTION OF THE DRAWINGS

This invention can be better understood by referring to the detailed description and the appended drawings, in which.

DETAILED DESCRIPTION

Figure 1:
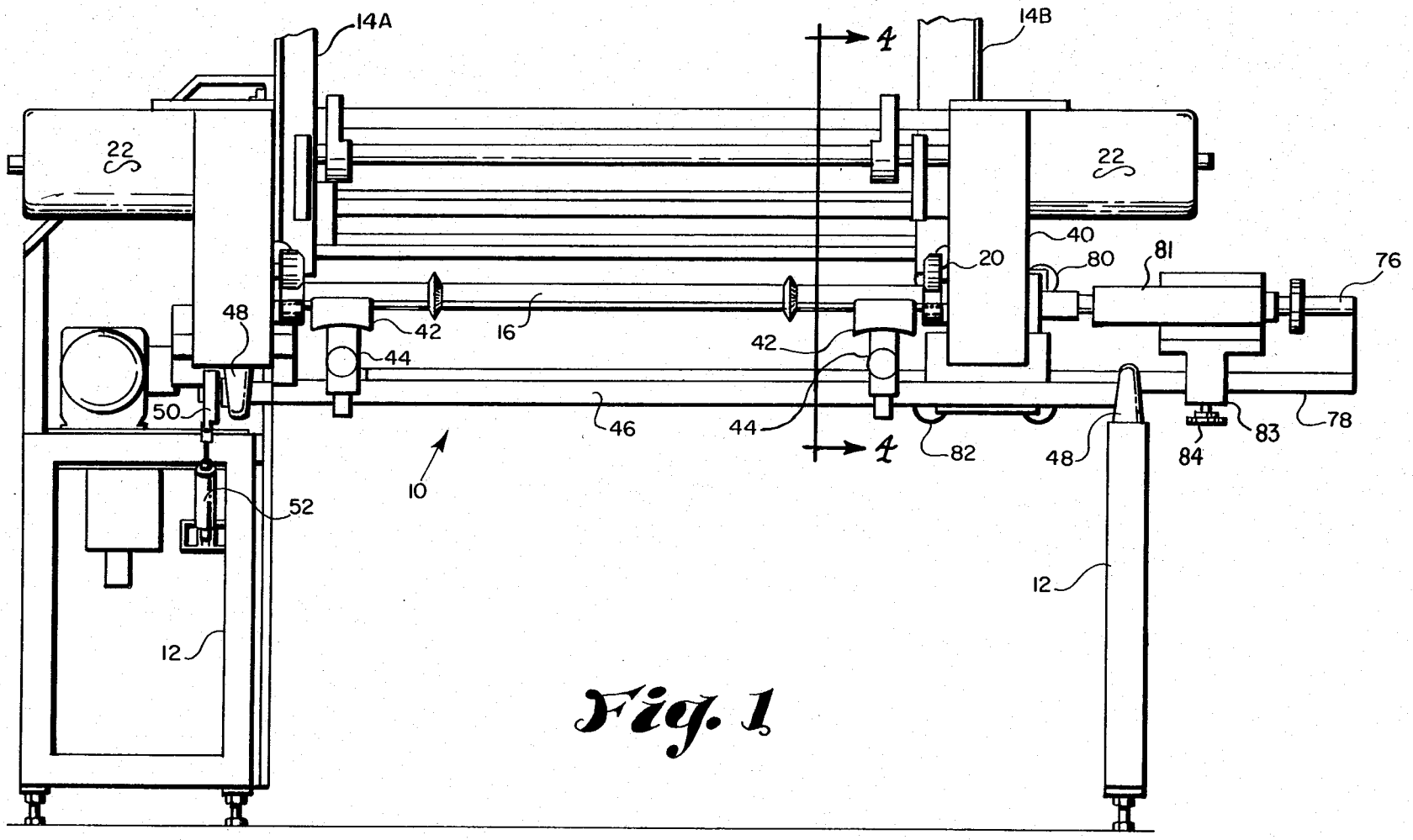
FIG. 1 is a front elevational view of the invented tenon crimper apparatus.
Figures 3, 5:
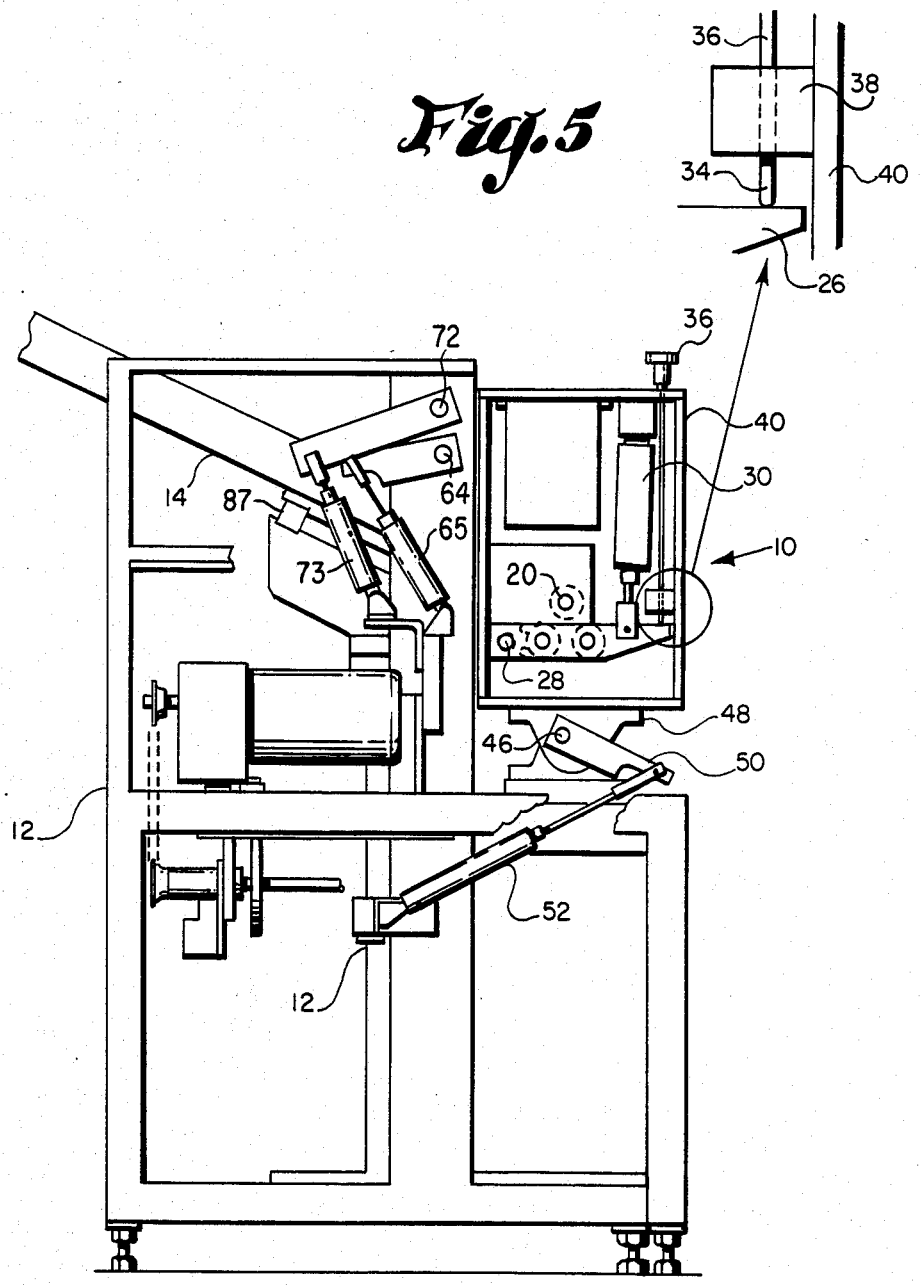
FIG. 3 is a left end view of the tenon crimper apparatus of FIG. 1.
FIG. 5 is an enlarged view of a portion of the apparatus shown in FIG. 3.
Figure 4:
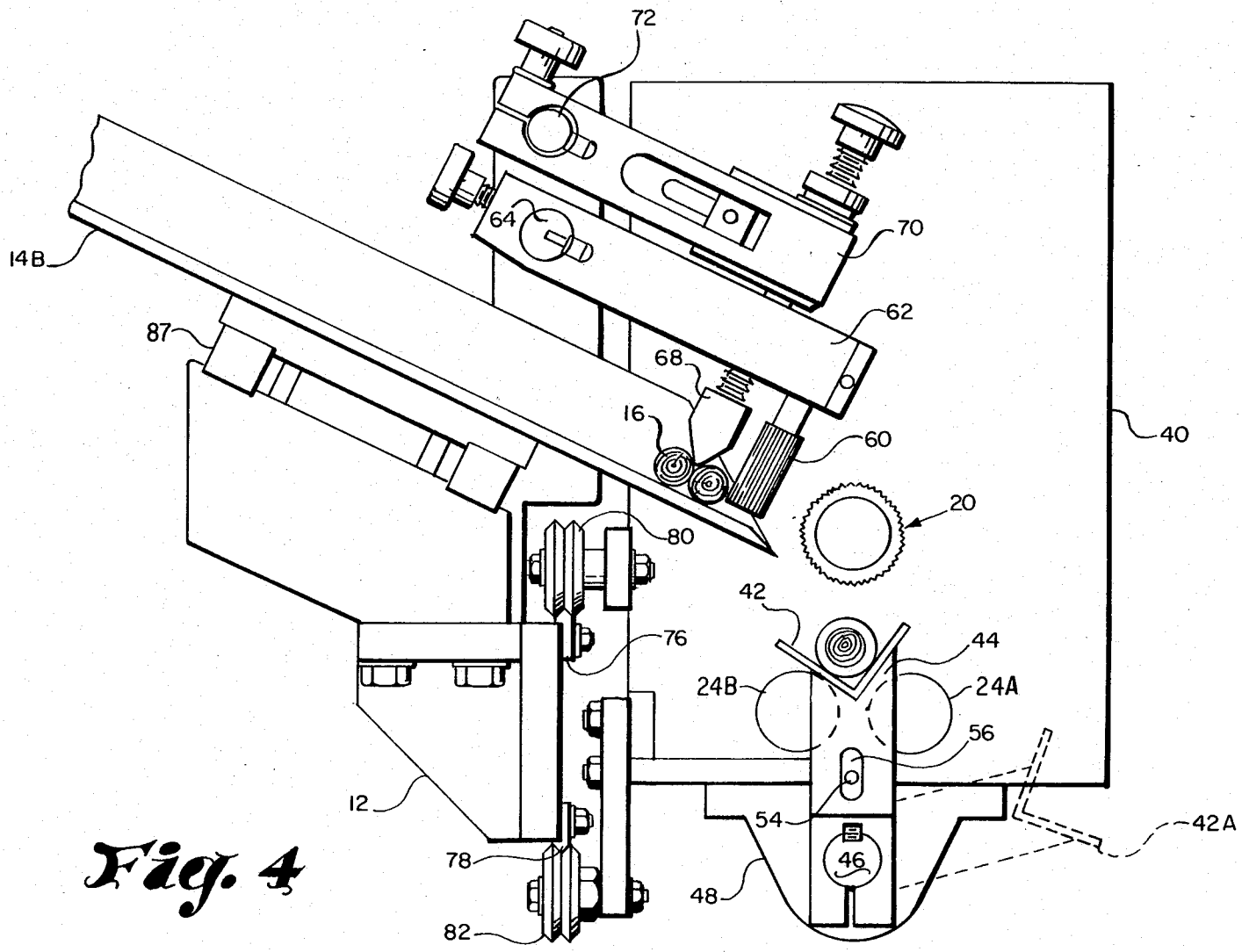
FIG. 4 is a partial side elevational view of the apparatus of FIG. 1 taken along the line 4—4 of FIG. 1.

As shown in FIG. 1 and FIG. 3, the components of tenon crimper apparatus 10 are mounted on a machine frame 12. A pair of horizontally spaced angle-shaped hopper rails 14A and 14B form a feed hopper 14 for workpieces 16, as shown in FIG. 4. The feed hopper mechanism holds one or more workpieces in readiness for movement to the crimping position so that no such workpiece comes into contact with the crimping mechanism prematurely.

Figure 2:
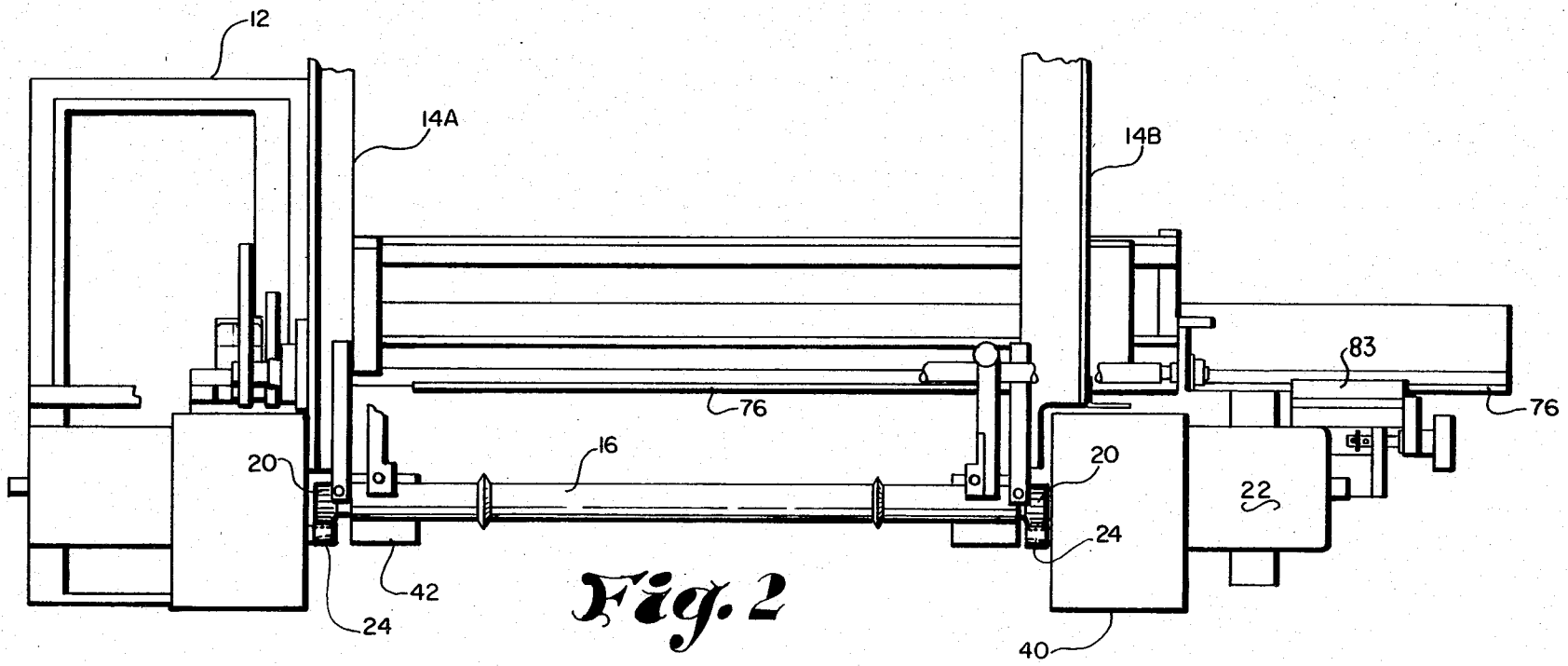
FIG. 2 is a top view of the tenon crimper apparatus of FIG. 1.

A crimp roll 20, best shown in FIG. 4, is coupled to a crimp roll drive motor 22 (FIGS. 1 and 2). A pair of idler rolls 24A and 24B are mounted on a pivotal support lever arm 26 which pivots about shaft 28. The rolls 20, 24A, and 24B form the three roll crimping mechanism or cluster. The driven crimping roll 20 is provided with straight knurling on its circumference, parallel to the axis of the roll. The two idler compression rolls have smooth surfaces.

The support lever arm 26 is connected to an actuator 30, shown as a piston driven air cylinder, which alternatively could be an hydraulic cylinder. An adjustable stop 34 is provided to limit the upward movement of the support arm 26. Stop 34 is preferably an adjusting screw 36, which is threadedly engaged in a nut 38 which is fixed to cluster housing 40, which is fixed to machine frame 12.

One or more V-shaped troughs 42 (two are shown) are provided to support the workpiece in proper position for crimping the tenon or tenons. The trough is upstanding from and fixed to an adjustable trough support 44, which is in turn fixed to a trough actuating shaft 46 journaled in bearings 48, which are fixed to the machine frame. The movement of the trough support and trough about shaft 46 is controlled by lever arm 50 fixed to shaft 46, the lever arm being connected to a trough discharge control means 52 such as an air cylinder, the other end of the air cylinder being connected to the machine frame. The height of the trough 42 above the shaft is adjusted by adjusting screw 54 in slot 56 to accommodate different diameter workpieces. The V-shape is preferably canted, as shown in FIG. 4 to prevent the workpiece from bouncing out of and over the trough.

The hopper 14, which has associated hopper feed system levers and air cylinders by which the machine is fed the wooden workpieces, guides the workpieces into the crimping mechanism. The hopper feed mechanism consists of the spaced workpiece supports or rails 14A and 14B, an adjustable feed finger 60 associated with a hopper feed finger support arm 62 which is rotatable with an actuating shaft 64 by actuation of associated piston 73; and adjustable feed stop 68 which is supported by feed stop arm 70 which in turn is fixed to and rotatable with feed arm actuating shaft 72.

When both ends of a work piece are to be fluted or crimped, a three-roll crimping mechanism (or crimping head) is provided at both ends of the hopper 14. Conversely, if ony one end of the workpiece is to be fluted or crimped, a suitable workpiece centering device is utilized to suitably position and support one end of the workpiece. One of the crimping heads is fixed and one is movable. In order to maintain perfect alignment of the tenons with respect to the two crimping roll clusters, upper and lower rails or tracks 76 and 78 are fixed to the machine frame, and rollers 80 and 82 on the movable crimping head engage the upper and lower tracks respectively, allowing lateral movement of the movable crimping head and its associated feed hopper rail. Clamping mechanism 83, including retaining screw 84 which is adapted to engage rail 78, holds the crimping head in the desired fixed position after manual adjustment of its location on the rails 76, 78. Such fixed position is determined by the length of the workpiece. All of the parts which are laterally movable along the rails 76,78 are collectively referred to as the crimping head. The hopper rails 14 are manually adjustable along lateral support rail 87 independently from the crimping head. The crimp roll 20 on the laterally movable crimping head rotates in the same direction of rotation as the crimp roll on the fixed crimping head. Both crimp rolls 20 are connected to their respective crimp roll drive motor assemblies so that they rotate constantly during normal operation.

The workpiece support 44 is adjustable along the length of trough actuating shaft 46 to accommodate variations in tenon and workpiece diameter or workpiece length, and is held in place by clamping means, or by a setscrew, or other desired adjusting means.

In operation, feed hopper rails 14A and 14B are fixed in the correct laterally-spaced positions for the particular length of workpiece 16. One or more workpieces, having a tenon end or ends which have been turned on a lathe to the proper tenon diameter, are placed into hopper 14, with feed finger 60 in the stop, or down, position, and feed stop 68 in the up, or disengaged, position.

After one workpiece has contacted feed finger 60, feed stop 68 is rotated about arm 64 into the stop position and is adjusted downwardly to contact the workpiece in the second feed position. Additional workpieces are added to the hopper as desired and may be added intermittently to assure a continuous operation.

Feed finger 60 is rotated out of the stop position allowing workpiece 16 to fall onto V-shaped troughs 42. Preferably there is sufficient clearance between the lower end of feed hopper 14 and crimping roll 20 for the workpiece to fall into proper lateral position for the crimping procedure. If, on the other hand, the workpiece is not properly positioned laterally, the movable carriage is moved laterally along tracks 76, 78, by air cylinder 81 to bring the crimping roll into the proper position for crimping with respect to the tenon.

After positioning the workpiece, the idler roll support arm 26 is moved upwardly until the idler rolls have lifted the workpiece off the trough 42 and brought it into contact with the continuously rotating crimping roll 20. Note that in the three-roll crimping mechanism, the crimping roll 20 is driven continuously by its associated drive motor 22, while the support and compression rolls 24A and 24B are idlers, that is undriven, turning only with the workpiece as it is turned by the crimping roll.

The action of the crimping roll 20 impresses flutes or crimps into the tenon. The dimension of the finished fluted tenon diameter is controlled by the elevation or location of adjustable stop 34, the setting of which determines the limit of upward movement of the idler compression roll lever arm 26 and the compression rolls 24, thus assuring that every workpiece will have the same tenon diameter upon discharge from the crimping mechanism, until such time as the adjustable stop is placed at a different elevation.

As soon as the workpiece 16 has completed the desired revolution, i.e., from one to two revolutions, preferably about ¼ revolutions, the compression roll lever arm 26 is released, dropping the compression rolls 24 downwardly beneath the elevation of trough 42 and repositioning the workpiece 16 in trough 42. The trough discharge air cylinder 52 is actuated, causing lever arm 50 to rotate the trough 42 about shaft 46 until workpiece 16 falls out of trough 42 by gravity into a collecting bin, not shown, after which the trough 42 is returned immediately to the support position, another workpiece 16 falls into it and the crimping cycle begins again.

The actions of the machine are readily controlled automatically, either by timed relays, or by computer control.

SUMMARY OF THE ACHIEVEMENT OF THE OBJECTS OF THE INVENTION

It is readily apparent from the foregoing that I have invented a tenon-fluting machine that is accurate and versatile, which is capable of fluting single or double tenon ends rapidly and easily. The machine compresses the wood to form the indentations due in part to easy and smooth centering by means of the idler roll lever arm and the adjustable lever stop. The invented method removes any possible "shine" caused by the compressive action. This shine is undesirable for gluing because the glue will not hold to a shiny surface tightly. There are no varying tolerances due to mechanical error or caused by humidity, and operation has shown that the fluted tenons can be stored for several weeks ahead of assembly time, rather than requiring the normal immediate "machine and assemble" technique. Glue flows more evenly up the sides of the tenon and is retained in the flutes, allowing the glue to take hold of a greater surface area of the tenon end, than on unfluted tenons.

In the drawings and specification there has been set forth a preferred embodiment of the invention and although specific terms are employed, they are used in a generic and descriptive sense only and not for purposes of limitation, the scope of the invention being defined only by the appended claims.

What is claimed is:

1. A method for crimping a round wooden tenon, comprising:

a. Feeding a wooden tenoned workpiece into a first position generally in axial alignment with a crimping mechanism;

b. moving the workpiece into crimping position against a knurled crimping roll;

c. forcing the tenon against a knurled portion of the crimping roll;

d. rotating the crimping roll and the tenon at least one complete revolution of the tenon;

e. releasing the pressure of the tenon against the crimping roll;

f. returning the workpiece to the first position; and g. discharging the workpiece from the first position.

2. A method according to claim 1 wherein said workpiece is rotated from one to two revolutions.

3. A method according to claim 1 wherein the crimping roll is rotated continuously.

4. A method according to claim 1 further comprising holding a second workpiece in a standby position ready for feeding into the first position upon discharge of said first workpiece.

5. A method for crimping the tenons of an elongated wooden workpiece having a round wooden tenon at each end, comprising:

a. feeding a tenoned workpiece from a first position into a second position generally in axial alignment with a pair of opposed crimping mechanisms, one of which is fixed, and one of which is movable;

b. moving the movable crimping mechanism longitudinally from a standby position to bring the crimping rolls thereof into crimping position relative to the workpiece;

c. exerting a compressive force on the tenons of the workpiece against the knurled portions of the crimping rolls;

d. rotating the crimping rolls in the same direction of rotation at least one complete rotation of the workpiece;

e. releasing the compressive pressure on the tenons;

f. returning the movable crimping head to its standby position by axial movement thereof, and g. discharging the workpiece from the second position.

6. A method according to claim 5 wherein said workpiece is rotated from one to two revolutions.

7. A method according to claim 5 wherein the crimping roll is rotated continuously.

8. A method for crimping a round wooden tenon with a knurled crimping roll, comprising:

a. feeding a wooden tenoned workpiece from a first feed position into a second position generally in axial alignment with a crimping mechanism;

b. moving the workpiece longitudinally from said second position into crimping position between two compression support rolls and a straight knurled crimping roll;

c. compressing the tenon against the knurled portion of the crimping roll;

d. rotating the crimping roll at least one complete rotation of the tenon;

e. releasing the compressive force on the tenon;

f. returning the workpiece to said second position by axial movement thereof; and g. discharging the workpiece from said second position.

9. A method according to claim 8 wherein said workpiece is rotated from one to two revolutions.

10. A method according to claim 8 wherein the crimping roll is rotated continuously.

11. Apparatus for crimping a round wooden tenon, comprising:

a. a machine frame;

b. a crimping roll cluster housing fixed to said frame;

c. a crimping roll cluster in said cluster housing, consisting of a drive roll and two idler compressing rolls, said drive roll being knurled on its circumference;

d. means attached to said frame for feeding a wooden tenoned workpiece into and out of axial alignment with the crimping roll cluster;

e. means for pressing said wooden tenoned workpiece into and out of engagement with the knurled portion of said knurled roll;

f. means for rotating said wooden tenoned workpiece against said knurled roll; and g. means for discharging said workpiece from said apparatus.

12. Apparatus according to claim 11 wherein said compressing rolls are mounted on a lever arm adapted for engaging said workpiece and moving it into and out of engagement with said knurled roll.

13. Apparatus according to claim 12 further comprising means for moving said lever arm a predetermined distance.

14. Apparatus according to claim 13 wherein said means for moving said lever arm is a fluid-operated cylinder attached to said lever arm and to said cluster housing.

15. Apparatus according to claim 14 wherein said cylinder is hydraulic.

16. Apparatus according to claim 14 wherein said cylinder is pneumatic.

17. Apparatus according to claim 13 wherein said cluster housing includes a lever arm limit stop mounted thereon.

18. Apparatus according to claim 17 wherein said lever arm limit stop is adjustable.

19. Apparatus according to claim 11 wherein said means for feeding said workpiece into and out of axial alignment comprises a feed hopper having associated workpiece stop means, and a V-shaped workpiece support beneath said hopper and generally in axial alignment with the crimping roll cluster.

20. Apparatus according to claim 19 wherein said feed hopper comprises a pair of spaced rails mounted on said frame in an inclined manner, whereby the workpieces roll down said hopper by the force of gravity.

21. Apparatus according to claim 20 wherein one of said spaced rails is laterally adjustable.

22. Apparatus according to claim 20 wherein said spaced rails have a cross-section of a structural angle.

23. Apparatus according to claim 19 wherein said feed hopper includes means for retaining a workpiece in a standby position.

24. Apparatus according to claim 23 wherein said means for retaining a workpiece is a feed finger, mounted for angular rotation on said frame.

25. Apparatus according to claim 23 wherein said feed hopper includes secondary means for retaining a workpiece in a secondary feed position, said secondary retaining means comprising an adjustable feed stop fixed to and rotatable with a feed stop arm and associated actuating shaft.

26. Apparatus according to claim 11 wherein said means for rotating said workpiece is said knurled roll, and an associated drive means for driving said knurled roll.

27. Apparatus according to claim 26 wherein said drive means is an electric motor.

28. Apparatus according to claim 11 wherein said means for discharging said workpiece comprises a shaft, parallel to said workpiece when in the crimping position, journaled for rotation in bearings fixed to said frame, a V-shaped workpiece support mounted on said shaft and rotatable therewith, and means for rotating said shaft through a predetermined angle of rotation and return to its original orientation.

29. Apparatus according to claim 28 wherein said means for rotating said shaft comprises a lever arm fixed to said shaft, and means connected to said lever arm and to said frame for moving said lever arm.

30. Apparatus according to claim 29 wherein said means for moving said lever arm is a pneumatic cylinder.

31. Apparatus according to claim 29 wherein said means for moving said lever arm is an hydraulic cylinder.

32. Apparatus according to claim 28 wherein said V-shaped support is vertically adjustable.

33. Apparatus according to claim 11 further comprising means for moving said crimping roll cluster housing laterally along said frame.

34. Apparatus according to claim 33 wherein said moving said cluster housing comprises upper and lower tracks fixed to said frame, at least two upper and two lower wheels mounted on said cluster housing engagable with said said upper and lower track respectively, and drive means associated with said cluster housing for moving said housing along said tracks.

35. Apparatus for crimping the tenons of a workpiece having tenons at both ends according to claim 33, further comprising a second crimping roll cluster opposite said first crimping roll cluster, said second cluster being fixed with regard to lateral movement, each roll of said second cluster being rotatable in the same angular direction as the corresponding roll in said movable cluster.

* * * * *

UNITED STATES PATENT AND TRADEMARK OFFICE

CERTIFICATE OF CORRECTION

PATENT NO. : 4,649,972

DATED : March 17, 1987

INVENTOR(S) : KENNETH BROOKS

It is certified that error appears in the above-identified patent and that said Letters Patent is hereby corrected as shown below:

In column 4, line 12, change "73" to -- 65 --.

In column 4, line 14, change "72" to -- 72 by actuation of associated piston 73 --.

In column 5, line 27, change "1/4" to -- 1 1/4 --.

In column 6, line 3, change "F" to -- f --.

In column 6, line 44, change "," to -- ; --.

Signed and Sealed this

Twenty-eighth Day of February, 1989

*Attest:*

DONALD J. QUIGG

*Attesting Officer*

*Commissioner of Patents and Trademarks*